United States Patent [19]

Hanson

[11] 4,419,393

[45] Dec. 6, 1983

[54] METHOD AND APPARATUS FOR USE IN APPLYING A BAND OF LIQUID ADHESIVE

[75] Inventor: Raymond Hanson, Rearsby, England

[73] Assignee: USM Corporation, Farmington, Conn.

[21] Appl. No.: 378,101

[22] Filed: May 14, 1982

[30] Foreign Application Priority Data

May 26, 1981 [GB] United Kingdom ..... 8115976

[51] Int. Cl.[3] ..... B05D 1/26

[52] U.S. Cl. ..... 427/430.1; 118/410; 222/490; 401/130; 401/136; 401/139

[58] Field of Search ..... 118/410, 411; 427/430.1; 222/490; 401/130, 136, 139, 261, 262, 263, 264, 265, 266, 267

[56] References Cited

U.S. PATENT DOCUMENTS

| | | | |
|---|---|---|---|
| 1,992,518 | 2/1935 | Werner | 401/264 |
| 2,021,653 | 11/1935 | Johnson | 401/266 |
| 2,056,325 | 10/1936 | MacKenzie | 118/410 |
| 2,305,899 | 12/1942 | Ritchie | 401/264 |

FOREIGN PATENT DOCUMENTS

| | | | |
|---|---|---|---|
| 556077 | 7/1923 | France | 222/490 |
| 447118 | 4/1949 | Italy | 222/490 |

*Primary Examiner*—Shrive P. Beck
*Attorney, Agent, or Firm*—Donald N. Halgren

[57] ABSTRACT

A method of applying a band of liquid adhesive in which the adhesive is spread by a resiliently flexible tapering applicator portion having an adhesive-guiding surface which extends to a narrow terminal spreading surface, the adhesive-guiding being concave about an axis which extends transversely of the spreading surface. The spreading surface is brought into contact with a workpiece, a pool of adhesive from an orifice in the adhesive-guiding surface is formed against the spreading surface, the applicator portion is caused to flex so that a portion of the adhesive-guiding surface extends along the workpiece surface, and relative movement between the workpiece and the applicator portion is brought about so that the adhesive is spread. An applicator head and an apparatus are also claimed.

14 Claims, 6 Drawing Figures

METHOD AND APPARATUS FOR USE IN APPLYING A BAND OF LIQUID ADHESIVE

BACKGROUND OF THE INVENTION (1) Field of the Invention

This invention is concerned with a method and apparatus for use in applying a band of liquid adhesive to a surface of a workpiece.

(2) Prior Art

In various industries, it is desired to apply a band of liquid adhesive to a surface of a workpiece so that the workpiece can subsequently be secured by the adhesive to another workpiece. In order to enable the band of adhesive to be correctly positioned on the surface, it is necessary that the band should have a substantially constant width with well-defined edges. For example, in the shoe industry, it is common practice to apply a band of liquid adhesive around the edge of the bottom surface of a lasted shoe upper so that the adhesive can be used to attach a sole to the lasted upper. In this case, the adhesive band needs to have well-defined edges so that the band can be laid close to the edge of the bottom surface of the upper, so as to ensure its deposition around the edge of the sole, without the adhesive spreading beyond the edge of the bottom surface of the upper on to the surface of the upper which would be visible on the finished shoe.

Various apparatuses have been used to apply a band of liquid adhesive which utilize applicators having rollers, brushes, doctor blades etc., for spreading the adhesive on the surface but with these apparatuses the tendency for the adhesive to spread sideways relative to the applicator means that it requires considerable skill to achieve a correctly positioned band of substantially constant width.

It is an object of the present invention to provide a method of applying a band of liquid adhesive in which the tendency for the adhesive to spread sideways relative to the applicator is counteracted.

BRIEF SUMMARY OF THE INVENTION

The invention provides a method of applying a band of liquid adhesive to a surface of a workpiece using an applicator head comprising a tapering applicator portion which is resiliently flexible and is provided with an adhesive-guiding surface which extends to a narrow terminal spreading surface of the applicator portion, the adhesive-guiding surface being concave about an axis which extends transversely of the spreading surface, that is, a partial cylindrical concavity transverse to the spreading surface, and an elongated orifice opening through the adhesive-guiding surface and extending generally parallel to the spreading surface, the method comprising supplying liquid adhesive to the orifice so that the adhesive flows through the orifice and down the adhesive-guiding surface to the spreading portion, bringing the surface of the workpiece into contact with the spreading surface so that a pool of adhesive forms on the surface against the spreading portion, causing the applicator portion to flex so that a portion of the adhesive-guiding surface extends along the surface of the workpiece, and bringing about relative movement between the applicator portion and the surface so that the pool of adhesive is spread on the surface by the applicator portion.

The invention also provides an apparatus suitable for use in a method according to the last preceding paragraph comprising a reservoir arranged to contain liquid adhesive, a control valve operable to control flow of liquid adhesive out of the reservoir, and an applicator head comprising a tapering applicator portion which is resiliently flexible and is provided with an adhesive-guiding surface which extends to a narrow terminal spreading surface of the applicator portion, the adhesive-guiding surface being concave about an axis which extends transversely of the spreading surface, that is, a partial cylindrical concavity transverse to the spreading surface, and an elongated orifice opening through the adhesive-guiding surface and extending generally parallel to the spreading surface, the applicator head being mounted so that liquid adhesive leaving the control valve enters the applicator head to flow out through the orifice thereof.

Since certain adhesives solidify on contact with air or atmospheric moisture and to prevent adhesive flowing through the orifice when the apparatus is not in use, preferably the applicator head is made of resiliently flexible material and the apparatus also comprises closing means operable to close the orifice of the applicator portion by deforming the applicator portion.

The invention also provides an applicator head suitable for use in an apparatus according to the last preceding paragraph but one comprising a tapering applicator portion which is resiliently flexible and is provided with an adhesive-guiding surface which extends to a narrow terminal spreading surface of the applicator portion, the adhesive-guiding surface being concave about an axis which extends transversely of the spreading surface, that is, a partial cylindrical concavity transverse to the spreading surface, and an elongated orifice opening through the adhesive-guiding surface and extending generally parallel to the spreading surface.

In order that most adhesives will not stick to the applicator head and solidified adhesive can therefore be readily removed from the applicator head, preferably the applicator head is cast from silicon rubber. The use of silicon rubber also has the advantages that it will withstand the temperatures of hot-melt adhesives and that it is readily cast without requiring expensive molding equipment.

Preferably, the spreading surface is formed between the adhesive-guiding surface and a generally planar surface of the applicator portion, the angle between the adhesive-guiding surface and the generally planar surface being between 30 degrees and 65 degrees. This allows bands of adhesive having a thickness of between 13 and 4 thousandths of an inch (0.33 to 0.1 millimeters) to be spread where the viscosity of the adhesive is approximately 17,000 centipoise. For a band of thickness 13 thousandths of an inch, said angle is preferably between 55 degrees and 65 degrees; while for a band of thickness 8 thousandths of an inch (0.2 millimeters), said angle is preferably between 37 degrees and 47 degrees.

In order to ensure substantially uniform thickness of the adhesive band across the band, the adhesive-guiding surface has a radius of curvature of between 3 and 7 centimeters; preferably the radius of curvature is between 4.5 and 5.5 centimeters. Preferably, the width of the orifice is between 0.5 and 1 millimeter.

BRIEF DESCRIPTION OF THE DRAWINGS

There now follows a detailed description, to be read with reference to the accompanying drawings, of an apparatus, and a method of applying a band of liquid adhesive to a surface, which are illustrative of the invention, it is to be understood that the illustrative apparatus and the illustrative method have been selected for description by way of example and not of limitation of the invention.

DESCRIPTION OF THE PREFERRED EMBODIMENT

Figure 5:
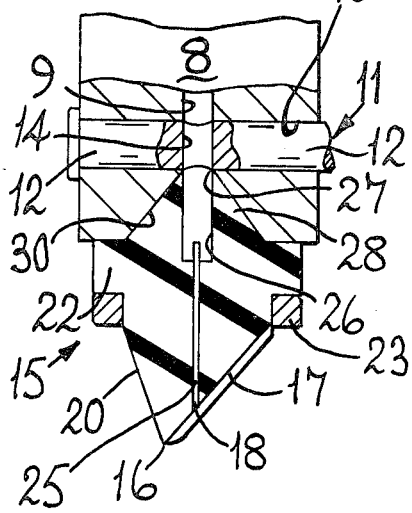
FIG. 5 is a sectional view taken through the applicator head shown in FIGS. 2 and 4 and a valve of the illustrative apparatus.

The illustrative apparatus comprises a reservoir 7 arranged to contain liquid adhesive. The adhesive may be introduced into the reservoir 7 in a liquid state or, if the adhesive is a hot melt adhesive, it may be introduced into the reservoir 7 in a solid state and melted by means of heaters (not shown) when required. The illustrative apparatus also comprises a valve block 8 secured to a lower end portion of the reservoir 7 and containing a cylindrical passage 9 (FIG. 5) which communicates with the interior of the reservoir 7 so that liquid adhesive can flow out of the reservoir 7 along the passage 9.

The valve block 8 has a bore 10 therein which intersects the passage 9 at right angles. The bore 10 contains a control valve 11 of the illustrative apparatus which is operable to control flow of the liquid adhesive out of the reservoir through the passage 9. The control valve 11 comprises a rod 12 contained within the bore 10 and rotatable in the bore 10 about a longitudinal axis of the rod 12 by means of a lever 13 (FIGS. 1 and 3) secured to an end portion of the rod 12 which projects beyond the valve block 8. The rod 12 contains a transverse bore 14 of the same diameter as the passage 9. Rotation of the rod 12 by means of the lever 13 is effective to move the bore 14 into alignment with the passage 9, so that liquid adhesive can flow through the bore 14, or out of alignment with the passage 9, so that the passage 9 is closed by the rod 12.

The illustrative apparatus also comprises an applicator head 15 comprising a tapering applicator portion which is resiliently flexible and is provided with an adhesive-guiding surface 17 which extends to a narrow terminal spreading surface 16 of the applicator portion, and an elongated orifice 18 opening through the adhesive-guiding surface 17 and extending generally parallel to the spreading portion 16.

The applicator head 15 is preferably made of silicon rubber having a hardness of 35 on the International Rubber Hardness Scale. The use of silicon rubber gives the necessary flexible resilience to the applicator portion and is readily molded without requiring expensive molding equipment. Furthermore, silicon rubber has the advantages that a wide range of adhesives will not stick readily to it, and that it will withstand relatively high temperatures.

Figure 4:
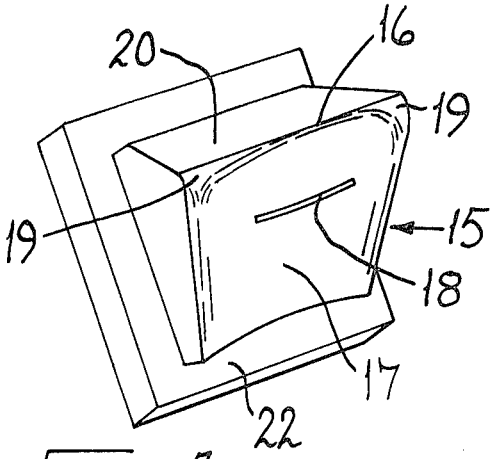
FIG. 4 is a perspective view of the applicator head shown in FIG. 2.

The spreading surface 16 of the applicator head 15 is narrower in a central region thereof than at end portions 19 thereof (FIG. 4), the reason for this will appear from the description below.

The adhesive-guiding surface 17 of the applicator head 15 is concave about an axis which extends transversely of the spreading surface 16 that is, a partial cylindrical concavity transverse to the spreading surface 16, which extends to the spreading surface 16. The surface 17 has a radius of curvature of 5 centimeters.

The orifice 18 is in the form of a slit extending parallel to the spreading surface 16. The orifice 18 has a width of 0.65 millimeters and is 16.5 millimeters long. The orifice 18 is 7 millimeters from the spreading surface 16. In variations of the applicator head 15, the distance of the orifice 18 from the spreading surface 16 may be different but it must be ensured that the adhesive will not solidify to an appreciable extent in flowing down the surface 17 to the spreading surface 16.

The spreading surface 16 is formed between the adhesive-guiding surface 17 and a generally planar surface 20 of the applicator head 15. Since the surface 20 is planar and the surface 17 is concave, it will not be apparent why the spreading surface 16 broadens at the end portions 19 thereof. In the applicator head 15, the angle between the surfaces 17 and 20 is 60 degrees. It is found that, when the illustrative apparatus is used to spread adhesive which has a viscosity of 17,000 centipoise, the thickness of the adhesive spread is 5 thousandths of an inch (0.13 millimeters). Furthermore, if variations of the applicator head 15 are produced in which said angle varies between 30 degrees and 65 degrees, the adhesive is spread to thicknesses in the range between 13 and 4 thousandths of an inch (0.33 to 0.1 millimeters).

The applicator head 15 also comprises an external flange 22 extending around the head 15 by which the head 15 is clamped to the valve block 8. A metal frame 23 fits under the flange 22 and is clamped by clamps 24 to the block 8.

The orifice 18 communicates with a passage 25 within the head 15 which is the same shape as the orifice 18 in cross-section. The passage 25, in turn, communicates with a cylindrical passage 26 within the head 15. The passage 26 has an entrance 27 (FIG. 5) at the crest of a generally-conical protruberance 28 of the head 15. The protruberance 28 is arranged to fit into a conical recess 30 in the block 8 so that the entrance 27 abuts the rod 12. The arrangement is such that, when the valve 11 is in an open condition, liquid adhesive can flow through the bore 14 into the passages 26 and 25 and out through the orifice 18. Since the entrance 27 abuts the rod 12, any solidification of the adhesive below the valve 11 occurs within the applicator head 15.

Figure 3:
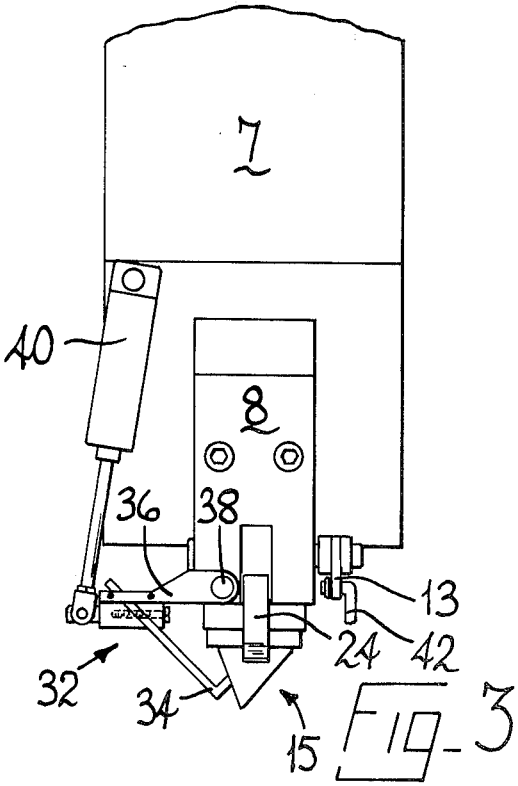
FIG. 3 is a view similar to FIG. 1 showing the illustrative apparatus in an inoperative condition.

The illustrative apparatus also comprises closing means 32 operable to close the orifice 18 of the applicator head 15 by deforming the applicator portion of the applicator head 15. The closing means 15 comprises a blade 34 (FIG. 3) mounted on an arm 36 which is mounted for pivoting movement about a pin 38 supported by the block 8 and a piston and cylinder assembly 40 operable to move the arm 36 about the pin 38 to bring the blade 34 into and of out of pressing contact with the surface 20 of the applicator portion. When the blade 34 is in pressing contact with the surface 20 (as shown in FIG. 3), it causes deformation of the applicator portion so that the orifice 18 is closed and adhesive cannot drop out of the orifice 18.

The closing means 32 and the valve 11 are arranged to operate together by a piston and cylinder assembly (not shown) in the same circuit as the assembly 40 being used to operate the lever 13 by pulling a rod 42 connected to the lever 13. Thus, the closing means 32 is arranged to operate to close the orifice 18 when the control valve 11 is operated to prevent flow of adhesive into the applicator head 15. Thus, when the illustrative apparatus is not in use, the orifice 18 and the valve 11 can be closed to prevent loss of adhesive and, in the case of adhesives which solidify upon contact with air, to minimize the risk of adhesive solidifying within the illustrative apparatus. However, should adhesive solidify within the applicator head 15, it will probably not stick to the silicon rubber of the applicator head 15 and can readily be removed by temporarily deforming the orifice 18 and inserting tweezers by which the solidified adhesive may be pulled through the deformed orifice 18.

Figure 6:
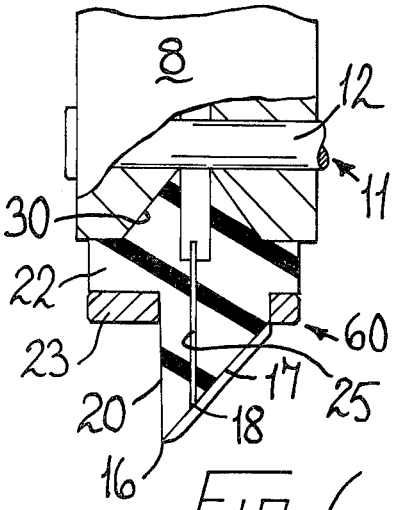
FIG. 6 is a view similar to FIG. 5 but showing an alternative applicator head of the illustrative apparatus.

Since the applicator head 15 is readily removable from the illustrative apparatus by loosening the clamps 24, it can readily be removed and replaced should it become damaged. Furthermore, when it is desired to vary the thickness of the adhesive spread by the illustrative apparatus, the applicator head 15 can be removed and replaced by a head which has a different angle between the surfaces 17 and 20 thereof. FIG. 6 shows an alternative applicator head 60 to the applicator head 15, the head 60 being identical to the head 15 except that the angle between the surfaces 17 and 20 is 42 degrees. It is found that the alternative head 60 spreads a coating which has a thickness of 8 thousandths of an inch (0.2 millimeters) when the adhesive has a viscosity of 17,000 centipoise.

The applicator head of the illustrative apparatus may have its spreading surface 16 shaped to correspond to the shape of the surface on which the adhesive is to be spread. For example, a convex curve in the surface may be accommodated by a complementary concave curve in the spreading surface 16.

The use of the illustrative apparatus in the illustrative method will now be described. In the illustrative method, a band of liquid adhesive is applied to the surface of a workpiece W which is in the form of a lasted shoe upper. It is desired to apply a band of adhesive around the edge of the bottom surface S of the upper W so that the adhesive can subsequently be used to attach a sole to the upper W. In the illustrative method, the illustrative apparatus is used with the applicator head 15.

In the illustrative method, liquid adhesive is placed in the reservoir 7 which is pressurized so that, upon opening the valve 11, the adhesive will flow into the passages 26 and 25 of the applicator head 15. When the valve 11 is opened, in the illustrative method, liquid adhesive is supplied to the orifice 18 through the passages 26 and 25, so that the adhesive flows through the orifice 18 and down the adhesive-guiding surface 17 to the spreading surface 16.

In the illustrative method, the surface S of the upper W is brought into contact with the spreading portion 16 so that a pool of adhesive forms on the surface S against the spreading surface 16, the pool being continually replenished by further adhesive running down the surface 17. The workpiece U is pressed against the surface 16, thereby causing the tapering applicator portion of the head 15 to flex (see FIG. 1) so that a portion of the adhesive-guiding surface 17 extends along the surface of the workpiece W. Care must be taken to ensure that the applicator portion does not flex so much that the orifice 18 contacts the surface S and is closed thereby. Next, in the illustrative method, relative movement is brought about between the applicator portion and the surface S so that the pool of adhesive is spread on the surface S by the applicator portion. The relative movement is brought about by moving the lasted upper W past the applicator head 15 so that the applicator portion makes a circuit of the edge of the surface S. It is found that a band of adhesive with well-defined edges is produced on the surface S making it possible for an operator to steer the lasted upper W so that the band is positioned close to the edge of the surface S without spilling adhesive over the edge of the surface S. It is necessary, however, that the lasted upper W is not moved so rapidly past the applicator portion that the pool of adhesive is depleted, otherwise an uneven band will result. In other words, the speed of movement of the upper W must match the rate of flow of adhesive.

Figure 1:
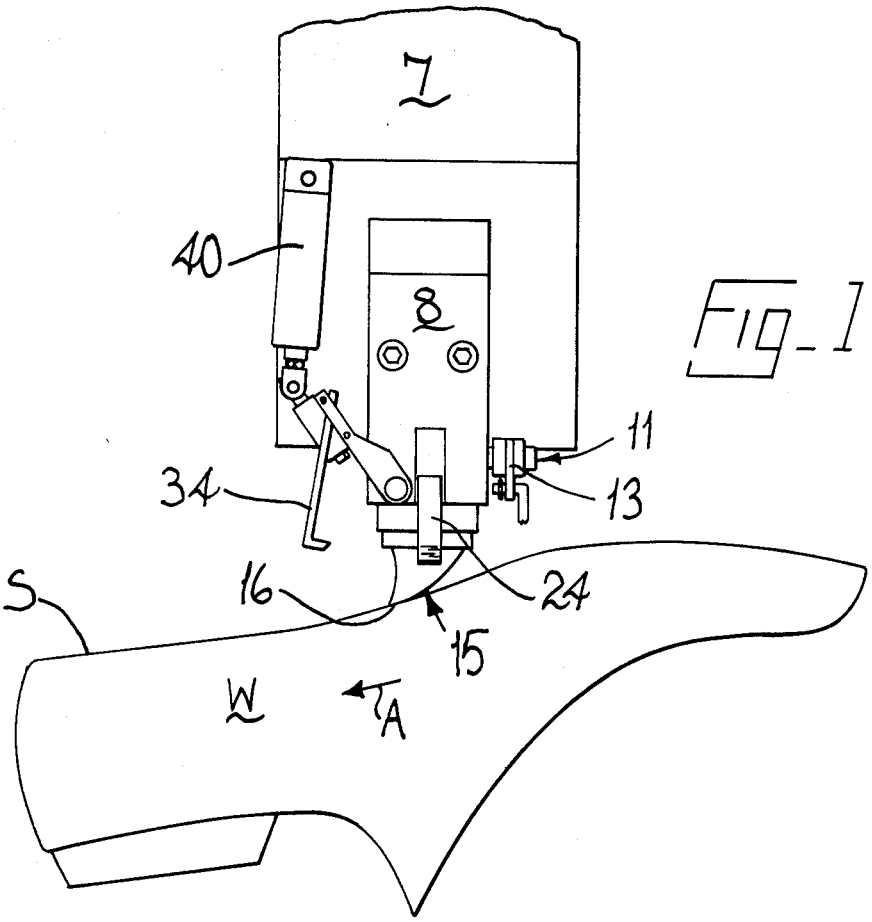
FIG. 1 is a side elevational view of the illustrative apparatus showing the apparatus operating on a workpiece.
Figure 2:
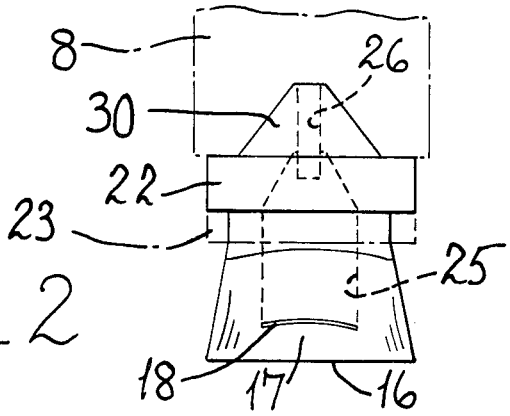
FIG. 2 is a front view, on a larger scale than FIG. 1, of an applicator head of the illustrative apparatus.

FIG. 1 shows the upper W moving past the applicator portion in the direction of the arrow A. Surprisingly, it is found that the thickness of the adhesive spread is substantially independent of the pressure applied between the surface S and the applicator portion but is dependent on the angle between the surface 17 and 20 of the applicator head. It is found that, if prior to flexing of the applicator portion, the adhesive-guiding surface 17 makes an angle of between 15 degrees and 45 degrees with the surface S, the adhesive adheres well to the surface S.

In the illustrative method and in the use of the illustrative apparatus, it is found that the partial cylindrical concavity of the surface 17 counteracts any tendency for the adhesive to spread transversely of the spreading portion 16. Furthermore, the band of adhesive spread is of substantially uniform thickness across the width of the band.

I claim:

1. A method of applying a band of liquid adhesive to a surface of a workpiece using an applicator head comprising:

providing a tapering applicator portion which is resiliently flexible and is provided with an adhesive-guiding surface which extends to a narrow terminal spreading surface of the applicator portion, the adhesive-guiding surface being partially cylindrical about an axis which extends transversely of the spreading surface, and an elongated orifice opening through the adhesive-guiding surface, and an extending generally parallel to the spreading surface;

supplying liquid adhesive to the orifice so that the adhesive flows through the orifice and down the adhesive-guiding surface to the spreading portion;

bringing the surface of the workpiece into contact with the spreading surface so that a pool of adhesive forms on the surface against the spreading portion;

causing the applicator portion to flex so that a portion of the adhesive-guiding surface extends along the surface of the workpiece; and bringing about relative movement between the applicator portion and the surface so that the pool of adhesive is spread on the surface by the applicator portion.

2. The method according to claim 1, wherein prior to flexing of the applicator portion, the adhesive-guiding surface makes an angle of between 15 degrees and 45 degrees with the surface of the workpiece.

3. An apparatus for applying a band of liquid adhesive to a surface of a workpiece comprising:

a reservoir arranged to containing a liquid adhesive;

a control valve operable to control flow of liquid adhesive out of the reservoir; and p1 an applicator head comprising a tapering applicator portion which is resiliently flexible and is provided with an adhesive-guiding surface which extends to a narrow terminal spreading surface of the applicator portion, the adhesive-guiding surface being partially cylindrical about an axis which extends transversely of the spreading surface, and an elongated orifice opening through the adhesive-guiding surface and extending generally parallel to the spreading surface, the applicator head being mounted so that the liquid adhesive leaving the control valve enters the applicator head to flow out through the orifice thereof.

4. An apparatus according to claim 3, wherein the apparatus also comprises closing means operable to close the orifice of the applicator portion by deforming the applicator portion.

5. An apparatus according to claim 4, wherein the closing means is arranged to operate to close the orifice when the control valve is operated to prevent flow of adhesive into the applicator head.

6. An apparatus according to claim 3, wherein the applicator head is readily removable from the apparatus and comprises a protruberance which, when the applicator head is mounted in the apparatus, it engages the control valve, the protruberance containing a passage connected to the orifice through which adhesive can flow to the orifice.

7. An apparatus according to claim 3, wherein said applicator head is cast from silicon rubber.

8. An apparatus according to claim 3, wherein said spreading surface is formed between the adhesive-guiding surface and a generally planar surface of the applicator portion, the angle between the adhesive-guiding surface and the generally planar surface being between 30° and 65°.

9. An apparatus according to claim 8, wherein said angle is between 55° and 65°.

10. An apparatus according to claim 8, wherein said angle is between 37° and 47°.

11. An apparatus according to claim 8, wherein the adhesive-guiding surface has a radius of curvature of between 3 centimeters and 7 centimeters.

12. An apparatus according to claim 8, wherein the adhesive-guiding surface has a radius of curvature of between 4.5 centimeters and 5.5 centimeters.

13. An apparatus according to claim 8, wherein said orifice has a width of between 0.5 and 1 millimeters.

14. An apparatus according to claim 13, also comprising an external flange by which said applicator head may be clamped to a support therefor.

* * * * *

UNITED STATES PATENT AND TRADEMARK OFFICE

CERTIFICATE OF CORRECTION

PATENT NO. : 4,419,393

DATED : December 6, 1983

INVENTOR(S) : Raymond Hanson

It is certified that error appears in the above-identified patent and that said Letters Patent is hereby corrected as shown below:

The title page should be deleted to appear as per attached title page.

Signed and Sealed this

*Twenty-fourth* Day of *April 1984*

[SEAL]

*Attest:*

GERALD J. MOSSINGHOFF

*Attesting Officer*

*Commissioner of Patents and Trademarks*

United States Patent [19]

Hanson

[11] 4,419,393

[45] Dec. 6, 1983

[54] METHOD AND APPARATUS FOR USE IN APPLYING A BAND OF LIQUID ADHESIVE

[75] Inventor: Raymond Hanson, Rearsby, England

[73] Assignee: USM Corporation, Farmington, Conn.

[21] Appl. No.: 378,101

[22] Filed: May 14, 1982

[30] Foreign Application Priority Data

May 26, 1981 [GB] United Kingdom ..... 8115976

[51] Int. Cl.[3] ..... B05D 1/26

[52] U.S. Cl. ..... 427/430.1; 118/410; 222/490; 401/130; 401/136; 401/139

[58] Field of Search ..... 118/410, 411; 427/430.1; 222/490; 401/130, 136, 139, 261, 262, 263, 264, 265, 266, 267

[56] References Cited

U.S. PATENT DOCUMENTS

| | | | |
|---|---|---|---|
| 1,992,518 | 2/1935 | Werner | 401/264 |
| 2,021,653 | 11/1935 | Johnson | 401/266 |
| 2,056,325 | 10/1936 | MacKenzie | 118/410 |
| 2,305,899 | 12/1942 | Ritchie | 401/264 |

FOREIGN PATENT DOCUMENTS

| | | | |
|---|---|---|---|
| 556077 | 7/1923 | France | 222/490 |
| 447118 | 4/1949 | Italy | 222/490 |

*Primary Examiner*—Shrive P. Beck

*Attorney, Agent, or Firm*—Donald N. Halgren

[57] ABSTRACT

A method of applying a band of liquid adhesive in which the adhesive is spread by a resiliently flexible tapering applicator portion having an adhesive-guiding surface which extends to a narrow terminal spreading surface, the adhesive-guiding being concave about an axis which extends transversely of the spreading surface. The spreading surface is brought into contact with a workpiece, a pool of adhesive from an orifice in the adhesive-guiding surface is formed against the spreading surface, the applicator portion is caused to flex so that a portion of the adhesive-guiding surface extends along the workpiece surface, and relative movement between the workpiece and the applicator portion is brought about so that the adhesive is spread. An applicator head and an apparatus are also claimed.

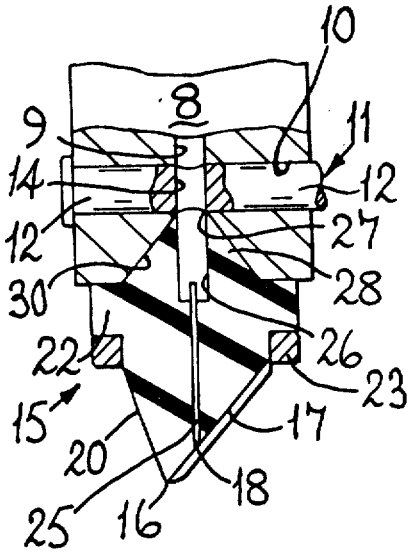

14 Claims, 6 Drawing Figures